US010639660B2

(12) United States Patent
Fries

(10) Patent No.: US 10,639,660 B2
(45) Date of Patent: May 5, 2020

(54) DISPENSING DEVICE

(71) Applicant: JOMA KUNSTSTOFFTECHNIK GMBH, Brunn am Gebirge (AT)

(72) Inventor: Rudolf Fries, Kaumberg (AT)

(73) Assignee: JOMA KUNSTSTOFFTECHNIK GMBH, Brunn am Gebirge (AT)

( * ) Notice: Subject to any disclaimer, the term of this patent is extended or adjusted under 35 U.S.C. 154(b) by 0 days.

(21) Appl. No.: 16/300,234

(22) PCT Filed: May 11, 2017

(86) PCT No.: PCT/AT2017/060123
§ 371 (c)(1),
(2) Date: Nov. 9, 2018

(87) PCT Pub. No.: WO2017/193150
PCT Pub. Date: Nov. 16, 2017

(65) Prior Publication Data

US 2019/0143354 A1 May 16, 2019

(30) Foreign Application Priority Data

May 12, 2016 (AT) ..... 50437/2016

(51) Int. Cl.
*B05B 11/00* (2006.01)

(52) U.S. Cl.
CPC .... *B05B 11/00418* (2018.08); *B05B 11/0075* (2013.01); *B05B 11/306* (2013.01);
(Continued)

(58) Field of Classification Search
CPC ..... B05B 11/00418; B05B 11/306; B05B 11/3008; B05B 11/0075; B05B 11/0072;
(Continued)

(56) References Cited

U.S. PATENT DOCUMENTS 6,164,498 A * 12/2000 Faughey ..... B05B 11/3008 222/153.13
6,443,331 B1 9/2002 DeJonge
(Continued)

FOREIGN PATENT DOCUMENTS

EP 0 098 939 1/1984
EP 1 460 001 9/2004
(Continued)

OTHER PUBLICATIONS

Austria Office Action conducted in counterpart Austria Appln. No. A 50437/2016-1 (dated Apr. 5, 2017) (w/ Machine translation).
(Continued)

*Primary Examiner* — Donnell A Long
(74) *Attorney, Agent, or Firm* — Greenblum & Bernstein, P.L.C.

(57) ABSTRACT

The invention relates to a dispensing device (1) having a pump device (2), which has an actuating element (5) having an output opening (12), wherein the actuating element (5) is movably arranged relative to a bearing element (6), which is connected to a pump housing (7) in a rotationally fixed manner in the usage position, wherein the actuating element (5) is rotatably arranged relative to the bearing element (6) and the bearing element (6) has at least one protruding bridge (25) having an upper stop edge (24) and a substantially tubular portion (5') of the actuating element (5) has, on the inner surface thereof, distributed over the circumference, at least two stages (22, 22', 22") defining a different displacement path, of which stages, depending on the rotational alignment of the actuating element (5), one stage (22, 22', 22") contacts the stop edge (24) in a lower displacement position.

24 Claims, 17 Drawing Sheets

(52) U.S. Cl.
CPC ..... *B05B 11/3008* (2013.01); *B05B 11/3059* (2013.01); *B05B 11/007* (2013.01); *B05B 11/0008* (2013.01); *B05B 11/0072* (2013.01); *B05B 11/3074* (2013.01)

(58) Field of Classification Search
CPC ..... B05B 11/007; B05B 11/3074; B05B 11/0008
USPC ..... 222/153.13, 153.07, 309, 490, 494
See application file for complete search history.

(56) References Cited

U.S. PATENT DOCUMENTS

| | | | | |
|---|---|---|---|---|
| 8,297,475 | B2 * | 10/2012 | Limbert | B05B 11/3087 222/153.07 |
| 2005/0072808 | A1 | 4/2005 | Kitamura | |
| 2009/0127294 | A1 * | 5/2009 | Krallmann | B65D 47/063 222/494 |
| 2014/0217130 | A1 * | 8/2014 | Ellenkamp-Van Olst | B65D 47/0809 222/494 |
| 2015/0048121 | A1 * | 2/2015 | Daansen | B05B 11/007 222/212 |
| 2015/0147430 | A1 * | 5/2015 | Dzikowicz | A23L 2/00 426/2 |
| 2016/0145032 | A1 * | 5/2016 | Fournet | B65D 83/40 222/153.07 |

FOREIGN PATENT DOCUMENTS

| | | | | |
|---|---|---|---|---|
| EP | 2 216 261 | | 8/2010 | |
| FR | 2 393 279 | | 12/1978 | |
| FR | 2393279 | A1 * | 12/1978 | B05B 11/0037 |
| FR | 2 493 515 | | 5/1982 | |
| FR | 2493515 | A1 * | 5/1982 | B01L 3/0224 |
| WO | 2010/043317 | | 4/2010 | |

OTHER PUBLICATIONS

Int'l Search Report (Form PCT/ISA/210) conducted in PCT/AT2017/060123 (dated Jul. 25, 2017).
Written Opinion (Form PCT/ISA/237) conducted in PCT/AT2017/060123 (dated Jul. 25, 2017).
Russia Office Action conducted in counterpart Russia Appln. No. 2018141190/05(068593) (dated May 7, 2019) (w/ translation).

* cited by examiner

DISPENSING DEVICE

The invention relates to a dispensing device with a pumping device, which has an actuating element with a discharge opening, wherein the actuating element is displaceably arranged relative to a bearing element, which is connected to a pump housing in a rotationally fixed manner in the usage position, wherein the actuating element is arranged such that it can rotate relative to the bearing element.

From EP 0 098 939 A2 an atomiser or metering pump of the type mentioned above is already of known art. For the setting of different delivery quantities via the metering pump, a part that can rotate is mounted on the pump housing, which has various projections or recesses, such that different stroke travels and thus different delivery quantities can be set in relation to a delivery head depending on the rotational direction of the part mounted such that it can rotate on the pump housing.

From U.S. Pat. No. 6,443,331 B1 a liquid dispensing device with an adjustable metering volume is also of known art. To set the metering volume, a cylinder element has two radially opposed projections which, depending on the direction of rotation of the dispensing spout and thus of a skirt connected to it, strike at different heights on projecting shoulders of an inner lining.

Comparable pumping devices are also of known art from e.g. EP 1 460 001 A1, FR2 493 515 A, EP2 21 62 61 A1 and WO 210/043317 A1.

The object of the present invention is now to create a dispensing device of the type mentioned in the introduction, in which the number of parts is reduced and in which a different dispensation quantity can be reliably set in a constructively simple manner.

In accordance with the invention, this as achieved in that the bearing element has at least one projecting land with an upper stop edge, wherein an essentially tubular section of the actuating element has on its inner surface, distributed over its circumference, at least two steps defining a different displacement travel, of which steps, depending on the direction of rotation of the actuating element, one step respectively strikes the stop edge in a lower displacement position.

By the formation of a land, which forms a stop edge, on the bearing element that carries the actuating element of the pumping device, wherein the actuating element has different steps for interaction with the stop edge of the bearing element, a different stroke travel can be reliably set when the actuating element is depressed—depending on the direction of rotation of the actuating element relative to the bearing element. Advantageously, it is not necessary to provide a separate, ring-shaped element for this purpose, as is of known prior art for stroke travel limitation, but rather a stroke adjustment and thus the setting of a metered quantity can be achieved in a simple and efficient way by the interaction of steps or stop edges formed on the actuating element and on the bearing element itself. The bearing element is arranged such that it cannot rotate in relation to the pump housing in the usage position, so that the bearing element forms a rotationally fixed reference point for the direction or rotation of the actuating element. Here any type of connection can be provided between the bearing element and the pump housing, wherein bearing element and pump housing can also be designed integrally with each other.

With such a dispensing device any flowable material such as liquid, gel-like or pasty media can in principle be dispensed, i.e. with the aid of the pumping device any flowable material can be dispensed in a metered manner from a container, with which the pumping device is connected in terms of fluid flow, wherein such dispensing devices are used particularly in hospitals and the like.

To avoid exposed projecting edges or steps, which tend to accumulate dirt and which would be particularly detrimental when the dispensing device is used in hospitals and the like, it is beneficial if a lower edge of the tubular section of the actuating element in an upper inoperative position covers the upper stop edge of the bearing element. Thus exposed edges that tend to accumulate dirt can be largely avoided, which is particularly advantageous when using the dispensing device in an environment with requirements for high levels of hygiene, e.g. in hospitals.

In order to move directly from one metering step to the next when the actuating element is rotated relative to the bearing element, it is advantageous if the steps are immediately adjacent to each other circumferentially and thus define a stepped profile. Several, e.g. four, different stroke travels can be defined by way of the stepped profile formed on the inner face of the tubular section of the actuating element, wherein three steps are required in the case of four different stroke travels or metering positions, since no step is provided in the metering position in which the entire stroke travel is released. One of these, e.g. three, steps advantageously forms a blocking position, in which the stroke or displacement travel of the actuating element relative to the bearing element is essentially blocked, so that in the design with three steps a blocking position as well as the dispensation of three different metering quantities is then provided, wherein in the third metering step the full displacement travel of the actuating element relative to the bearing element is released, i.e. in this metering step no projecting step limiting the displacement travel is provided on the inner face of the tubular section of the actuating element.

In order to make it easy for the user to see that a change has been made between two metering steps, it is beneficial it, in an extension of the jump in level between two adjacent steps, guide lands running in the direction of displacement are provided. By providing such guide lands running in the direction of displacement, a guide land must be overcome by the land provided with the stop edge on the bearing element when the actuating element is rotated in relation to the bearing element, such that the actuating element and/or the bearing element are elastically deformed. After the two elements have been disengaged once again, they snap back into their initial positions, so that by means of this snapping or latching process the user of the dispensing device can hear and/or feel that a different metering step has now been set.

It is also advantageous if a blocking step is designed in such a way that, when aligned with the stop edge, the actuating element is essentially blocked in its upper inoperative position, so that steps provided on the inner face of the tubular section of the actuating element can not only be used to define different dispensation quantities, but at the same time—when the actuating element is turned in the appropriate direction relative to the bearing element—a blocking position can also be set in which the actuating element is reliably prevented from being depressed and thus a dispensation of the fluid medium is reliably prevented.

Alternatively, the actuating element can also be fixed in a downwards-displaced position, such that the transport volume or the dispensing device is advantageously reduced. For the fixing of the actuating element in a lower inoperative position it is beneficial if a, preferably circumferential, flange-like projection is provided in a lower end section of the actuating element. This projection can be used to hold the actuating element in a lower blocking position in conjunction with an engaging part on the bearing element, e.g. in a groove or the like.

If a pull-off flap or tamper-evident ring is provided, which is connected to the bearing element and which blocks the displacement or rotation of the actuating element from an upper or lower inoperative position, the actuating element can easily be blocked in the blocking inoperative position by adding a pull-off flap, wherein the actuating element is only mounted in a displaceable or rotatable manner after removal of the pull-off flap. This means that the pull-off flap can be used to achieve tamper-evident protection in a simple manner. When securing in a lower inoperative position, the tamper-evident ring preferably defines a circumferential groove between a lower edge of the tamper-evident ring and a lower flange of the bearing element, in which the projection on the actuating element is accommodated in the blocking position, i.e. if the tamper-evident ring is connected to the bearing element. Needless to say, all the designs described above can also be used for tamper-evident protection, with a pull-off flap or tamper-evident ring, independently of the steps defining a different displacement travel depending on the direction of rotation of the actuating element, i.e. in any dispensing devices with a bearing element and an actuating element.

In order reliably to prevent tilting between step and stop edge, it is beneficial to provide two diametrically arranged lands together with stop edges and correspondingly diametrically configured steps. Accordingly, two diametrically opposed lands are provided on the bearing element and the actuating element has two diametrically opposed steps per metering step, which are at the same height in the direction of displacement. Thus, it is advantageous for symmetrical force to be applied when the opposing steps impinge against the opposing stop edges, so that oblique positioning or tilting of the actuating element during depression is reliably prevented.

In respect of a structurally simple design, it is beneficial if the bearing element is connected to the pump housing by means of a screw connection. Here a lid of a container, from which the dispensing device removes a fluid medium to be dispensed, can in particular be accommodated at the same time between a flange provided on the bearing element and a flange provided on the pump housing, so that when the bearing element and pump housing are screwed together, the pump device is at the same time fastened to the lid. Needless to say, the bearing element, pump housing and/or lid can also be integrally designed.

In order reliably to prevent the penetration of dirt into the discharge opening of the pumping device, it is advantageous if the discharge opening of the actuating element is provided with a protective cap, which has a slot-shaped ejection port. With the aid of such a protective cap, which has a slot-shaped ejection port, in particular a cross slot-shaped ejection port, the fluid medium to be discharged can easily emerge from the discharge opening through the protective cap as a result of elastic deformation of the slot-shaped opening, wherein after a pumping operation the slot-shaped ejection port of the protective cap closes automatically and thus any penetration of dirt into the discharge opening or the medium temporarily stored in an end section of the actuating element is reliably prevented, as is any drying out of the temporarily stored medium.

In respect of a structurally simple design for the fastening of the protective cap in the area of the discharge opening of the actuating element, it is beneficial if the protective cap has a circumferential bead that is accommodated in a detent groove of the actuating element arranged adjacent to the discharge opening.

In order to form the protective cap with a slit-shaped ejection port, which on the one hand can easily be penetrated by the fluid medium, but on the other hand also produces a dirt-repellent closure in the closed position, it is advantageous if the protective cap consists of a thermoplastic elastomer (TPE), preferably of a thermoplastic vulcanisate (TPV), in particular of ethylene-propylene-diene-monomer rubber particles (EPDM) in a matrix of polypropylene, or silicone.

In respect of the design of the pumping device, it is advantageous in connection with the metered dispensation of the fluid medium if the actuating element is connected to a piston rod that is moved together with the actuating element, preferably against the restoring force of an elastic spring element, wherein a valve element is accommodated in the actuating element and the piston rod is displaceably accommodated in the pump housing, which is provided at one end with a one-way valve, preferably a ball valve.

Here it has been shown to be particularly advantageous if the pump housing is accommodated in a riser sleeve in which a riser tube is accommodated, which is communicatively connected to the one-way valve.

With such a design with a riser sleeve, it is also possible that the pumping device is connected to the interior of a container, and is connected to the container by means or a lid. A displaceably mounted overrun sleeve, which is essentially tightly connected to the riser sleeve and the container, is preferably accommodated in the container, so that the overrun sleeve is sucked downwards by the negative pressure generated by the pumping device and thus the fluid medium accommodated in the container is essentially tightly sealed over the entire service life of the dispensing device without large surfaces being exposed, leading to the fluid medium in these regions drying out adversely; in addition, this advantageously also prevents the medium from adhering to the inner wall of the container.

If the overrun sleeve has a circumferential sealing lip, preferably a single lip, which widens conically upwards in the direction of the lid, the overrun sleeve can easily be inserted into the container, in particular mechanically, in the course of assembly. Needless to say, such an overrun sleeve can also be used independently of the steps defining a different displacement travel as a function of the direction of rotation of the actuating element, i.e. it can also be used for any dispensing device with a bearing element and an actuating element.

The invention is explained in more detail below on the basis of preferred examples of embodiment depicted in the drawings, wherein the invention is in no way to be limited to these. In the figures.

Figure 1:
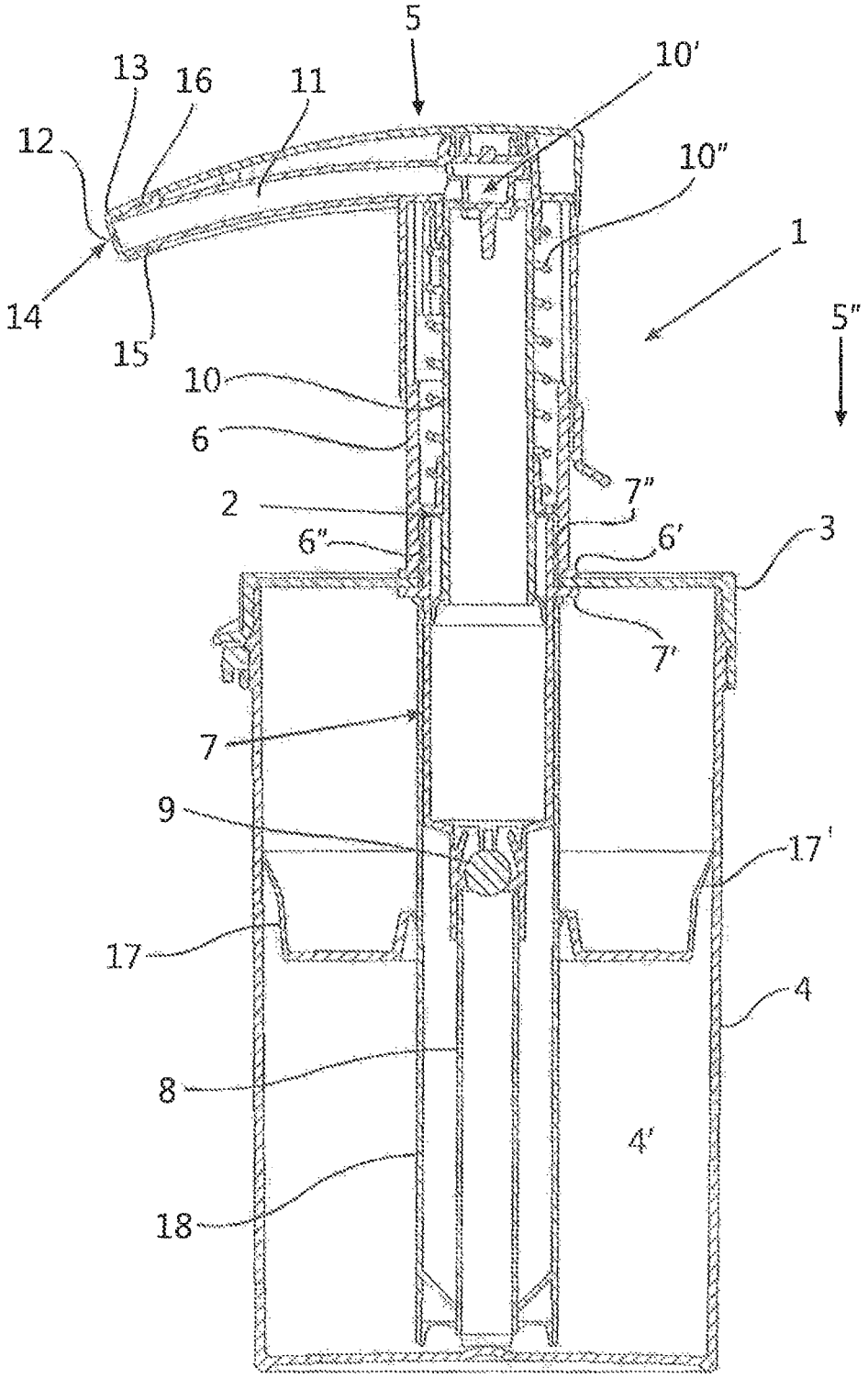
FIG. 1 shows a cross-sectional view of an inventive dispensing device, which is connected to a container.
Figure 2:
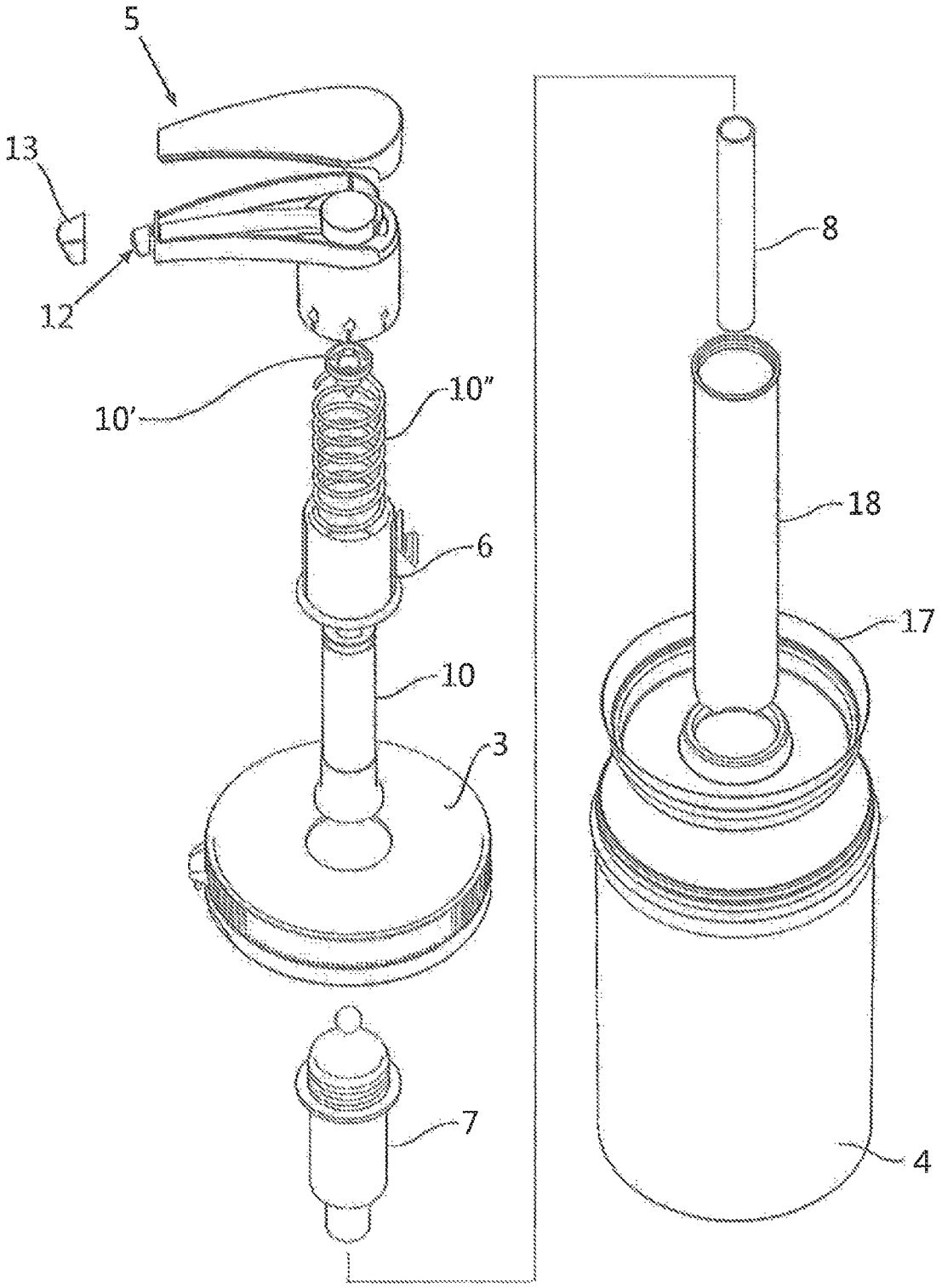
FIG. 2 shows an exploded perspective view of the individual elements of the dispensing device together with the container.
Figure 3:
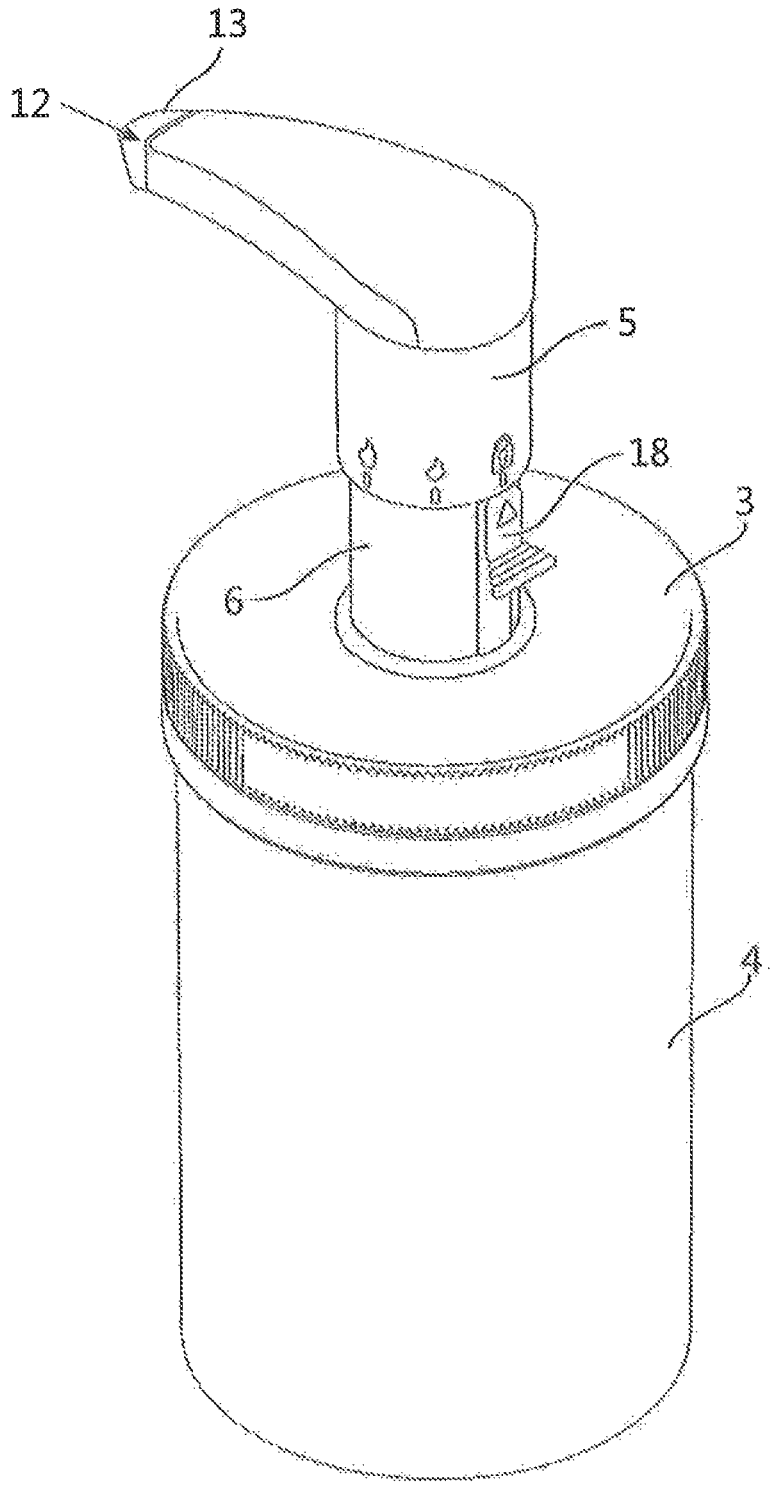
FIG. 3 shows a perspective view of the dispensing device in a position connected to the lid and partially accommodated in a container.

FIGS. 1 to 3 show a dispensing device 1 with a device 2 connected to a lid 3 of a container 4.

Any fluid medium can be contained in the container 4; the medium can be dispensed from the container 4 in a metered manner by means of the pumping device 2. For this purpose, the pump device 2 has an actuating element 5 or actuator, which is designed to be displaceable and rotatable in relation to a bearing element 6 designed as a screw cap.

The pump device 2 has a pump housing 7 in which the fluid medium previously accommodated in the container interior 4, after passing from the container interior 4' via a riser tube 8 through a ball valve 3, is temporarily stored. When the actuating element 5 is displaced in the direction 5", the volume of the pump housing 7 is reduced by a piston rod 10 connected to the actuating element, such that the fluid medium temporarily stored in the pump housing or cylinder 7 passes through the valve 10' and can escape via the outlet channel 11 and the discharge opening 12 of the actuating element 5.

In the position shown in FIG. 1, the actuating element 5 is in an upper inoperative position, into which the actuating element 5 is automatically returned by means of a helical spring 10", which acts between the bearing element 6 and the actuating element 5, after the actuating element 5 has been depressed in order to dispense the fluid medium.

The pump housing 7 and the bearing element 6 each have a flange, 7' and 6' respectively, at their ends. In addition, the bearing element has an internal thread 6" in a lower end section and the pump housing 7 has a corresponding external thread 7" in an upper end section. With the production of a screw connection that is rotationally fixed when in use, a connection can be made readily and easily between the pump device 2 and the container 4 by clamping the lid 3 between the two flanges 6' and 7'.

The discharge opening 12 is protected with a protective cap 13, which has a slit-shaped, preferably cross slit-shaped, valve 14.

The protective cap 13 has a circumferential latching bead 15, which is latched to a corresponding groove 16 of the actuating element 5 adjacent to the discharge opening 12, such that the protective cap 13 can easily be attached to the actuating element 5. The slot-shaped protective cap 13, which preferably consists of a thermoplastic vulcanisate, in particular Santoprene (™) or the like, opens and closes automatically so that, in the closed position of the slot-shaped valve 14, any penetration of dirt into the medium temporarily stored in the actuating element 5 is prevented, as is, to a large extent, any drying out of the fluid medium as a result of exposed surfaces.

Furthermore, FIGS. 1 and 2 show a so-called overrun sleeve 17, which abuts in a sealing manner against the inner face of the cylindrical container 4 and on a riser sleeve 18'" enclosing the riser tube 8. Thus, the negative pressure generated during the pumping process inside the container 4' moves the overrun sleeve 17 downwards, together with the medium to be pumped, as a result of the negative pressure, so that during the emptying of the container 4 the overrun sleeve 17 abuts essentially continuously against the surface of the medium to be delivered.

Figure 4:
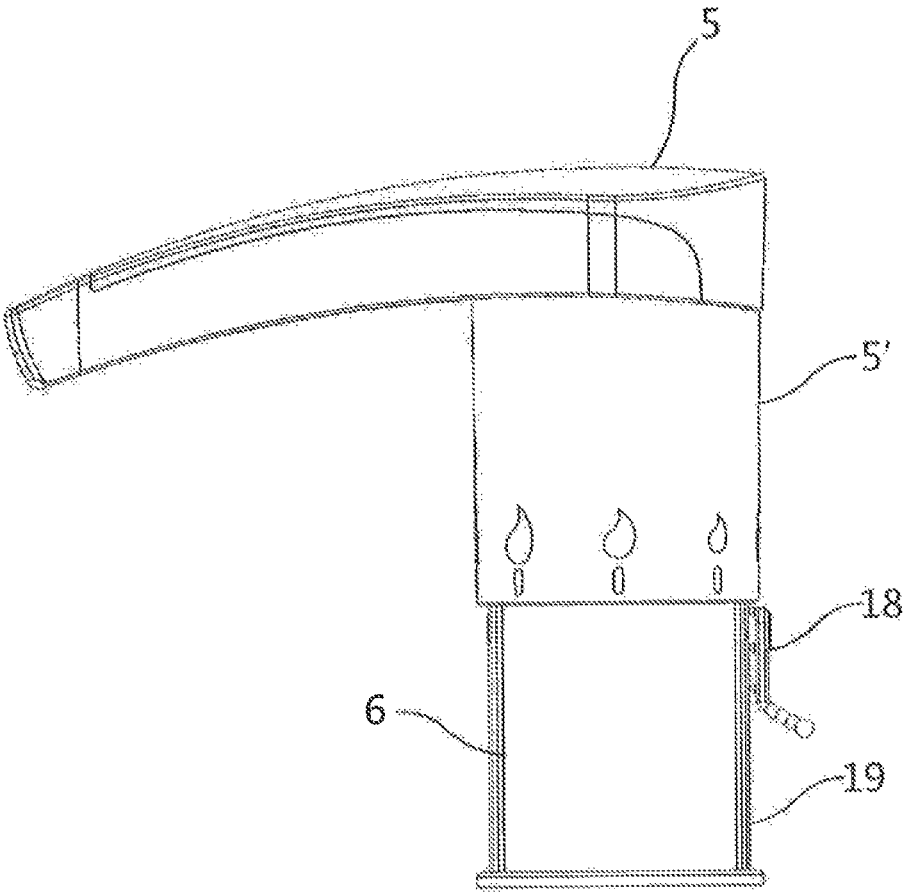
FIG. 4 shows a side view of an actuating element of the dispensing device arranged on a hearing member.
Figure 4A:
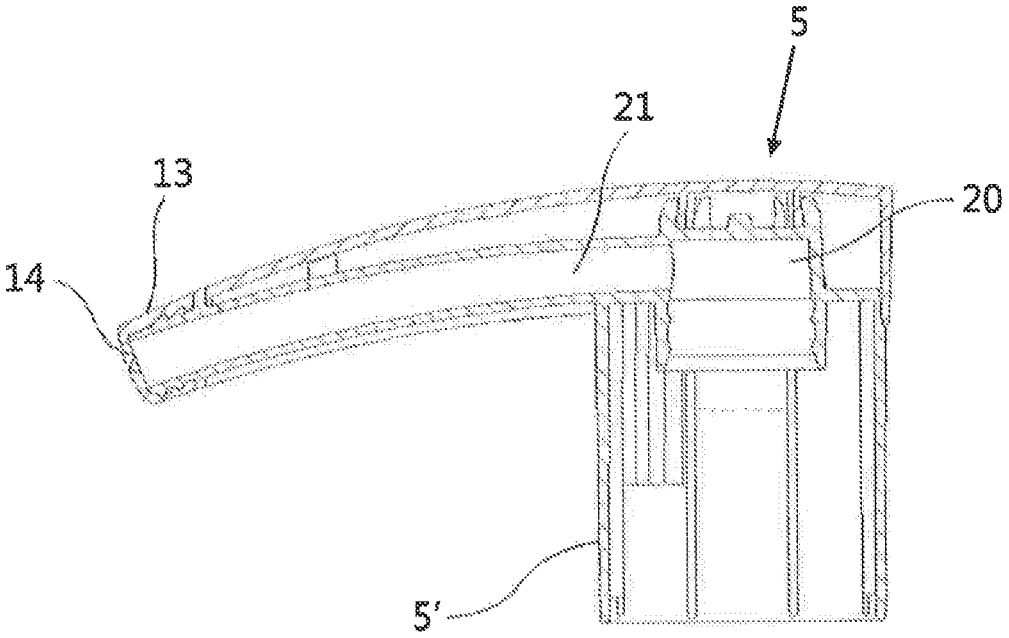
FIG. 4A shows a cross-sectional view of the actuating element in FIG. 4.

In FIGS. 4 and 4*a* the actuating element 5 is shown in detail, in particular in FIG. 4*a* it is shown that the actuating element 5 has a tubular section 5' that is pushed over the bearing element 6 in a downwards displaced dispensing position.

Figure 5:
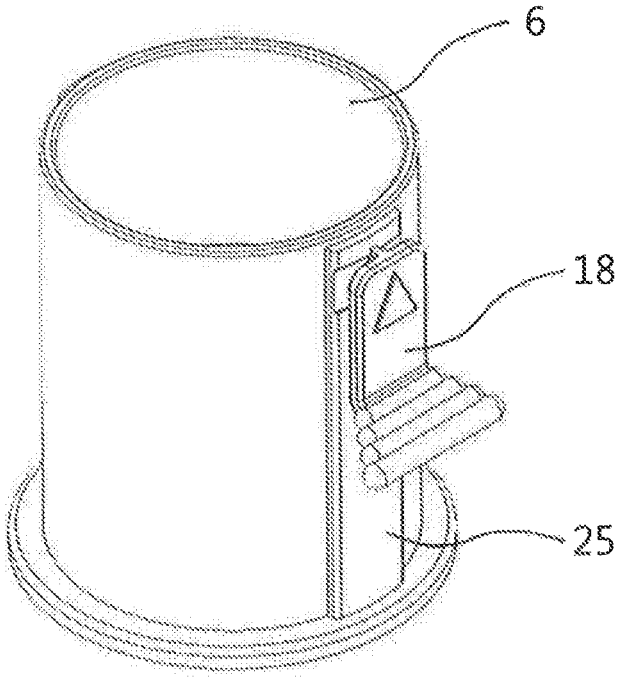
FIG. 5 shows a perspective view of the bearing element including the tamper-evident flap.
Figure 6:
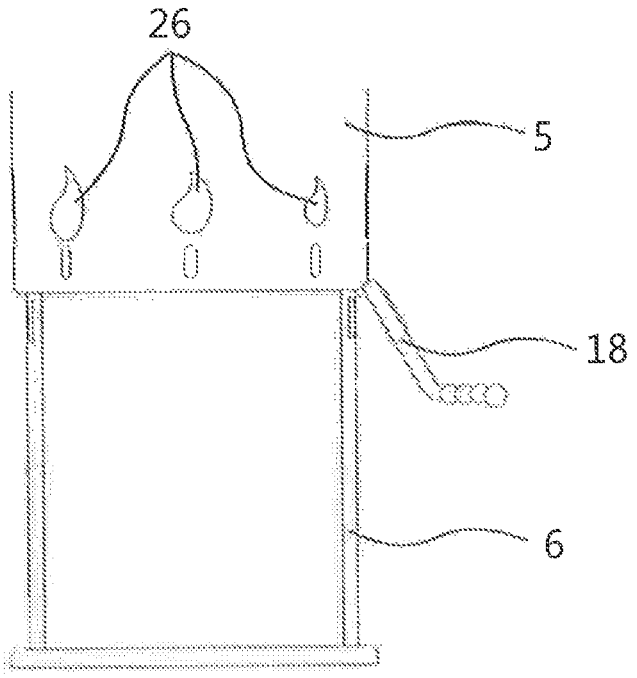
FIG. 6 shows a view of the bearing and actuating elements while the tamper-evident flap is removed.

As shown in FIGS. 4 to 6, a pull-off flap 18, which is attached to the bearing element 6 by means of thin-walled lands 19 that are easily detachable, can be used to prevent the actuating element 5 from sliding downwards. If, therefore, the pull-off flap 18 is not removed from the bearing element 6, it is not possible to actuate the actuating element 5, and it is therefore obvious to the user that the dispensing device 1 is still unused, i.e. is in its original condition; the pull-off flap 18 therefore serves as a tamper-evident seal.

In the cross-sectional view in accordance with FIG. 4*a* it is further apparent that the actuating element 5 has a valve seat 20, in which a valve 10 is accommodated, which opens when the actuating element 5 is depressed, whereby the medium to be dispensed can pass into a dispensing channel 21. The dispensing channel 21 leads into the discharge opening 12. To protect the discharge opening 12 from contamination, a protective cap 13 has been snapped on in the vicinity of the discharge opening 12 by way of a snap-in bead 15 in a detent groove 16, as explained above.

In FIGS. 7 and 8*a* to 8*c* the dispensing device is shown in different metering positions, wherein in each metering position a different stroke or displacement travel is released for the actuating element 5, so that the dispensation of different volumes can be set. For the setting of the different metering steps, only the direction of rotation of the actuating element 5 relative to the bearing element needs to be changed.

Figure 7:
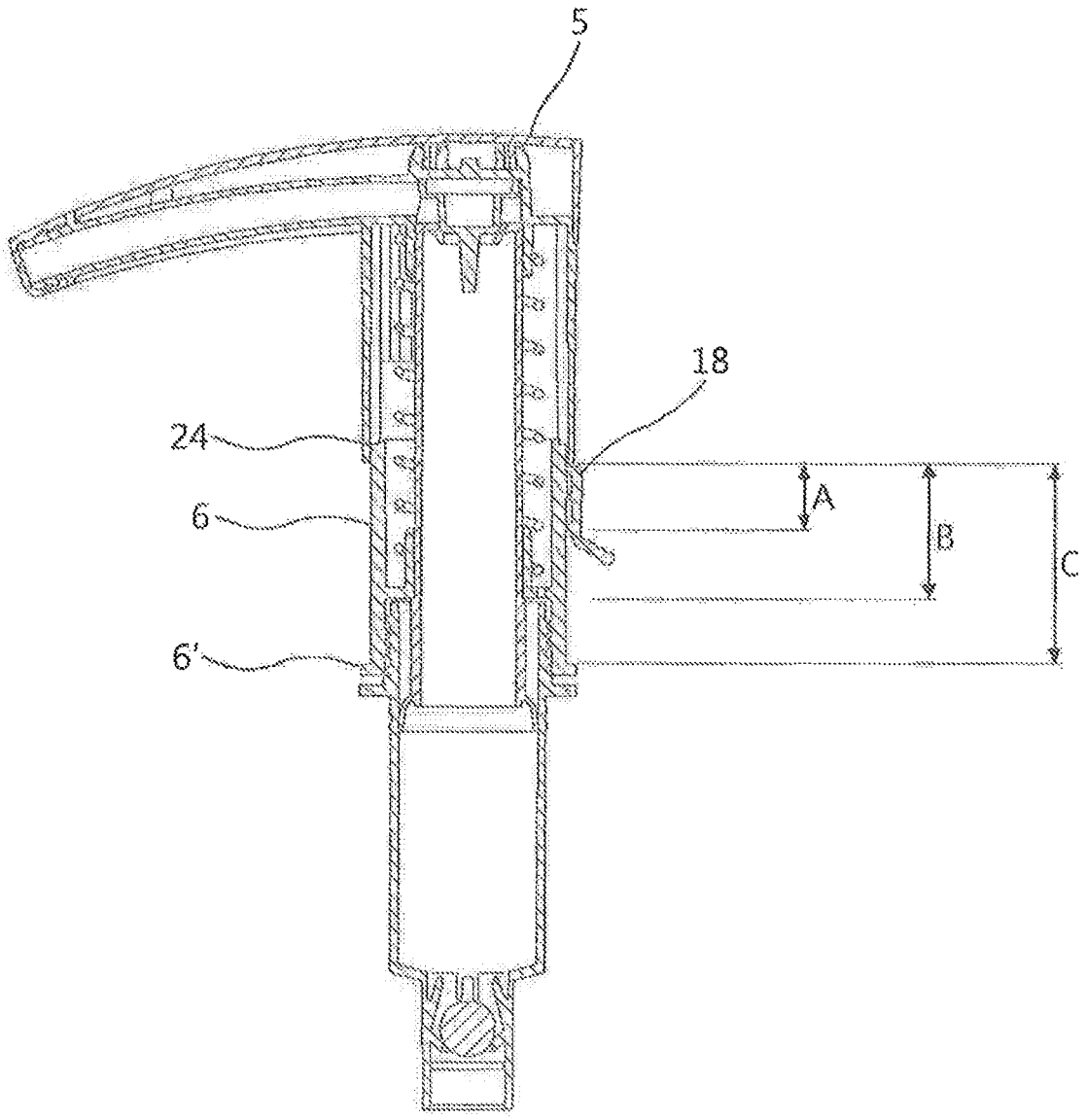
FIG. 7 shows a cross-sectional view of the dispensing device in an upper inoperative position.
Figure 8A:
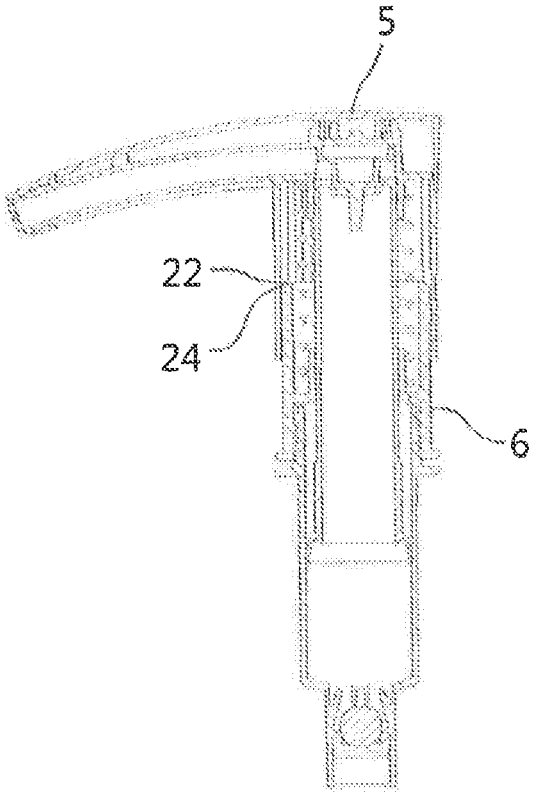
FIG. 8A shows a cross-sectional view of the dispensing device in FIG. 7 with the actuating element in a rotational position corresponding to a metering step 1.
Figure 8B:
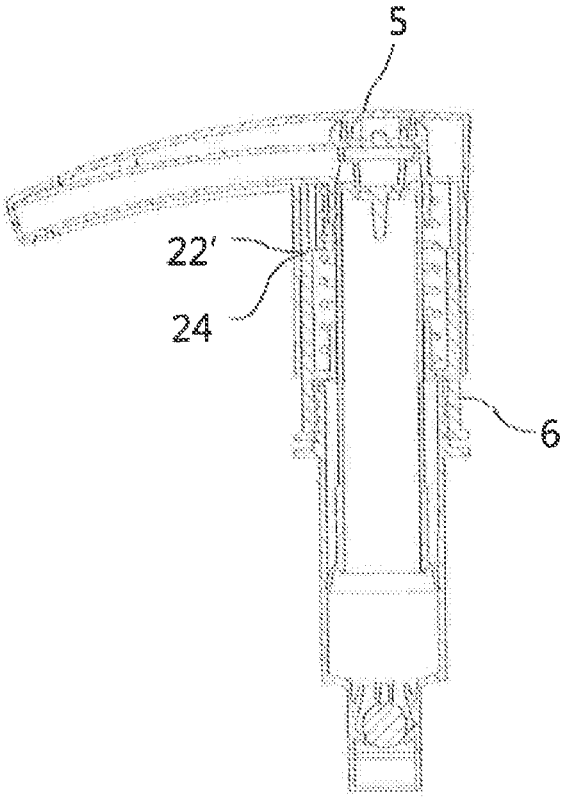
FIG. 8B shows a cross-sectional view in accordance with FIG. 8A with the actuating element in a rotational position corresponding to a metering step 2.
Figure 8C:
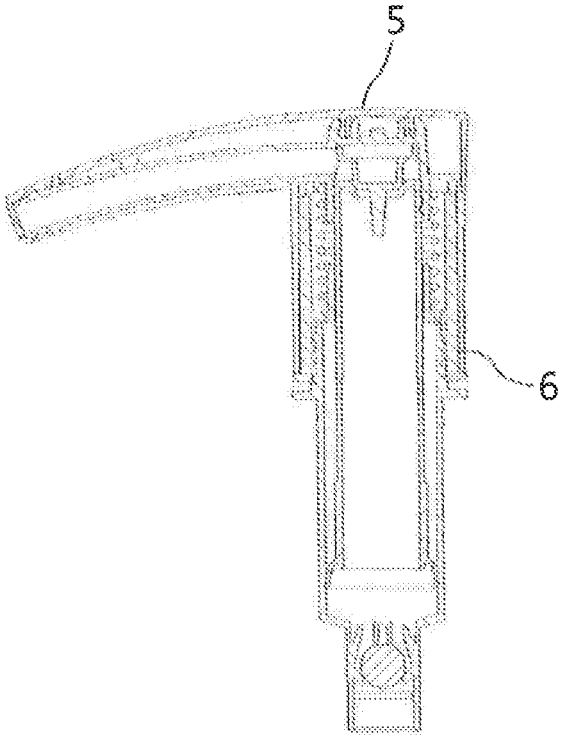
FIG. 8C shows a cross-sectional view in accordance with FIGS. 8A and 8*b* with the actuating element in a rotational position corresponding to a metering step 3.
Figure 9:
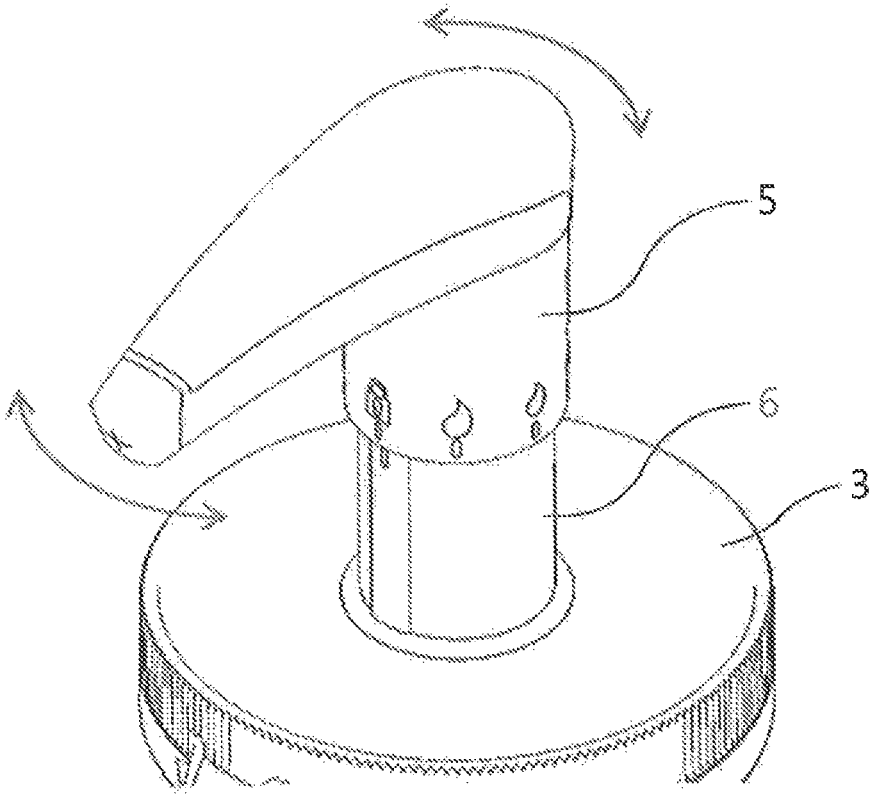
FIG. 9 shows a perspective view of the dispensing device attached to a lid.

In the blocked position shown in FIG. 7, the actuating element 5 is aligned in such a way that a step 22 projecting into the interior of the tubular section 5', which step 22 is arranged directly adjacent to a lower edge 23 of the tubular section, already rests on an upper stop edge 24 of a projecting land 25 on the bearing element 6, so that the actuating element 5—even after removal of the tamper-evident flap 18 shown in FIG. 7, cf. FIG. 6—is essentially immovable. Thus a movement of the actuating element, or a metered dispensation of the medium via the dispensing device, is not possible m this blocking metering position.

If the actuating element 5 is rotated relative to the bearing element 6, a step 22' (cf. also FIG. 11) on the inner surface of the tubular section 5' comes into alignment with the land 25, so that the stroke or displacement travel is defined in a first metering step which corresponds to the distance A (cf. FIG. 7) between the stop edge 24 on the bearing element 6 (cf. FIG. 12) and the step 22' of the actuating element 5 in its (upper) inoperative position. The steps 22, 22' and 22" are formed in the example of embodiment shown by a plurality of ribs arranged next to each other, but can of course also be defined by a step projecting two-dimensionally in each case, which then forms a continuous contact surface for the stop edge 24.

For the metering of a larger dispensation quantity, the actuating element 5 can be further rotated in relation to the bearing element 6, such that the step 22" is aligned with the land 25. Thus a longer stroke travel is defined, which corresponds to the distance B (cf. FIG. 7) between the stop edge 24 on the bearing element 6 (cf. FIG. 12) and the step 22" of the actuating element 5 in its (upper) inoperative position.

In a third metering step, the area 22''' is arranged in alignment with the land 25 of the bearing element 6, in which the tubular section 5' of the actuating element 5 has no projecting step, so that the actuating element 5 can be pressed downwards over the entire stroke C (see FIG. 7) until the lower edge 23 sits on a connecting flange 6' of the bearing element 6. The different stroke travels are compared in FIG. 7.

Figure 10:
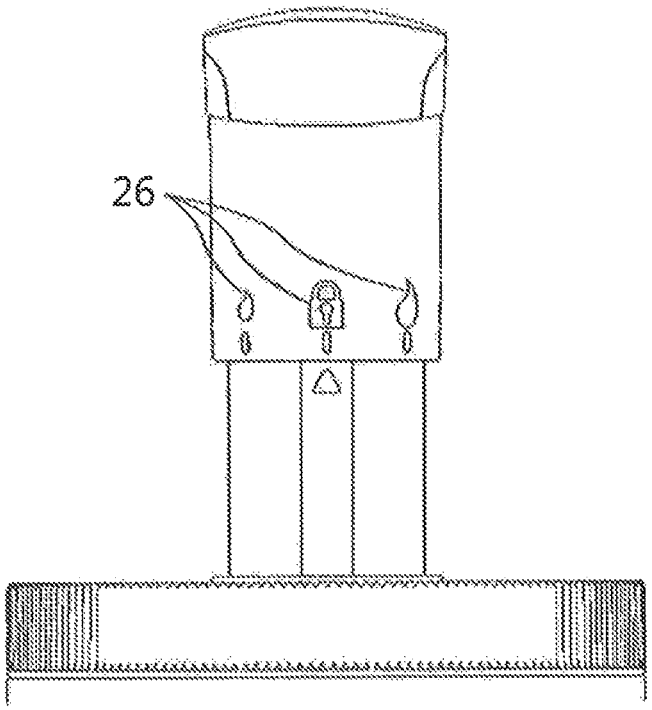
FIG. 10 shows a view of the dispensing device in a blocked position.

As shown in FIG. 10, the actuating element 5 has markings 26 assigned to the different directions of rotation, so that the user can easily see whether a zero, large or small quantity is dispensed when the actuating element 5 is depressed. In addition, guide lands 27 extending in the displacement or axial direction 5" of the tubular section 5' are provided on the inner face of the tubular section 5'—as shown in particular in FIG. 11—in each case in an extension of a jump in level between two steps 22, 22', 22" and the step-free section 22''', such that a guide is formed in each case between two adjacent guide lands 27, in which the land 25 is guided when the actuating element 5 is displaced.

Figure 11:
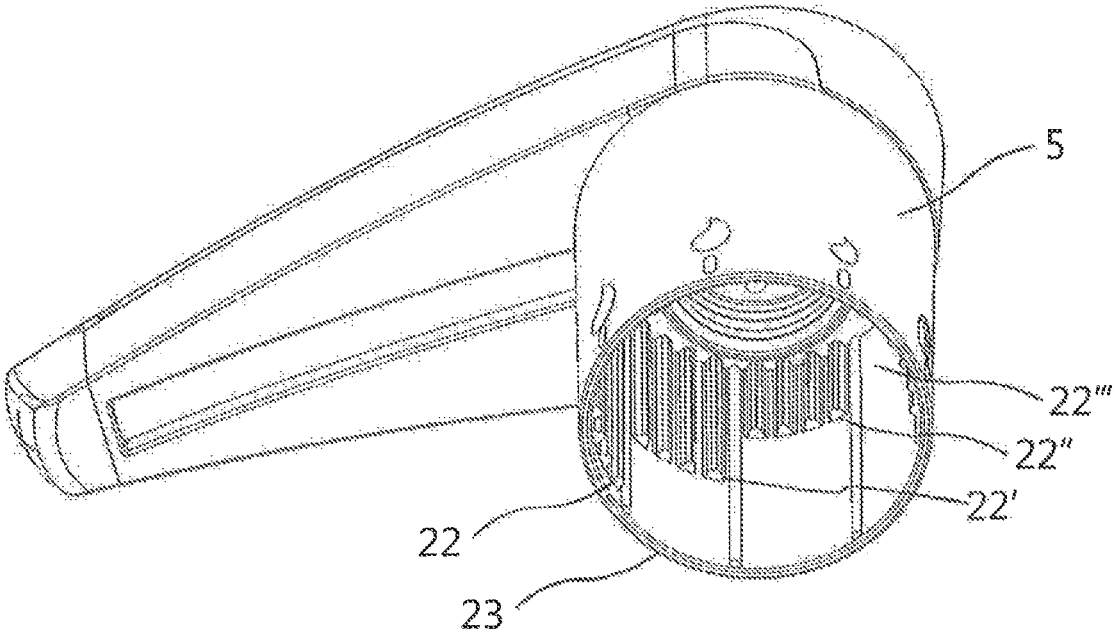
FIG. 11 shows a perspective view from below into a tubular section of the actuating element.
Figure 12:
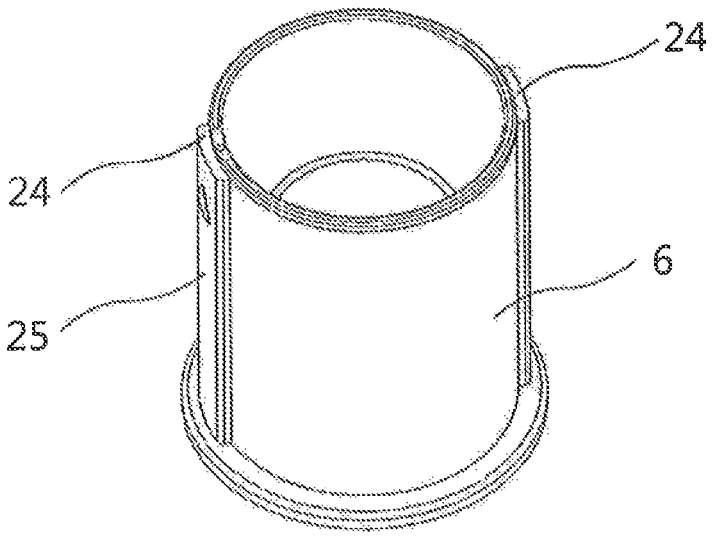
FIG. 12 shows a perspective view of the bearing element.

In order to change the metering position accordingly it is necessary to move the land 25 over a guide land 27. This requires an elastic deformation of the tubular section 5' and/or the bearing element 6, such that the land 25 snaps into the adjacent guide after overcoming the guide land 27. The user can hear and/or feel this snap-in process, so that the user can easily detect that the metering position has been changed. FIGS. 11 and 12 also show that preferably two diametrically opposed lands 25 are provided with corresponding stop edges 24; correspondingly two opposite steps 22, 22', 22" or step-free areas 22''' are provided in each case, so that when the steps 22, 22', 22" encounter the stop edges 24 any oblique positioning of the actuating element 5 is avoided.

Figure 13:
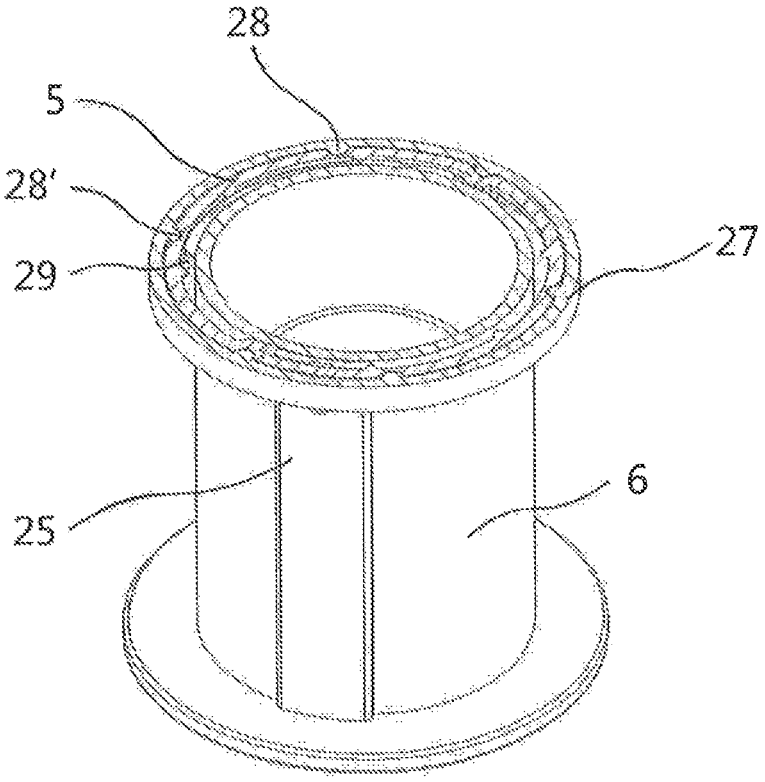
FIG. 13 shows a perspective view of an alternative design of a tamper-evident closure with a tamper-evident ring.

FIG. 13 shows an alternative design of a tamper-evident closure instead of the pull-off or tamper-evident flap 18. Here a tamper-evident ring 27 is provided, which has some projecting lands 28 distributed around the circumference, which are accommodated in corresponding groove-shaped recesses 28' of the actuating element 5, which is only shown to a limited extent in FIG. 13.

Here the tamper-evident ring 27 is connected to the bearing element 6 via thin-walled, land-shaped elements 29. Only by turning the actuating element 5 out of the blocked position and the associated release of the connection between the lands 28 and the bearing element 6, can the actuating element 5 be released from the blocked position, whereby the tamper-evident ring 27 is released from its upper position. After the tamper-evident ring 27 on the bearing element 6 has slipped downwards, it is clear to the user that the dispensing device 1 is no longer in its original sealed state.

In the design in accordance with the invention, the diametrically opposed lands 25 and the stepped design of steps 22, 22', 22" on the inner surface of the actuating element 5 can therefore be used to achieve in a simple manner a metering of the quantity of fluid medium dispensed by the pumping device 2 when actuated.

Figure 14A:
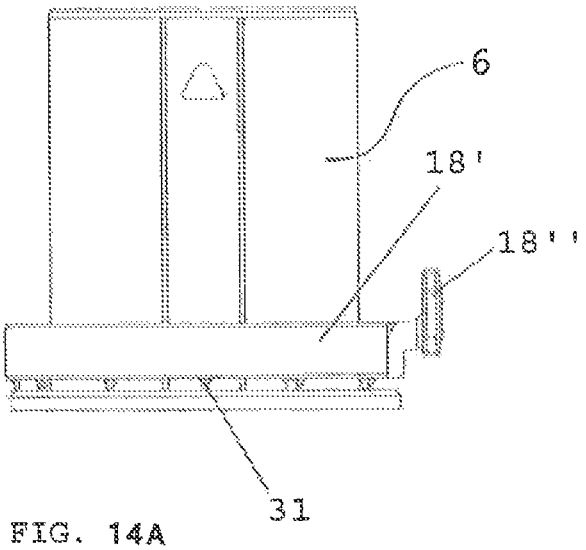
FIG. 14A shows a side view of the bearing element in accordance with FIG. 14 with the tamper-evident ring (without actuating element)
Figure 14B:
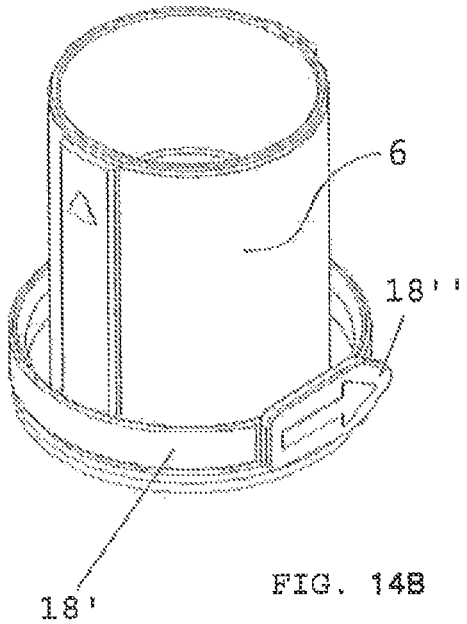
FIG. 14B shows a perspective view of the bearing element in accordance with FIG. 14 with the tamper-evident ring (without actuating element).
Figure 14:
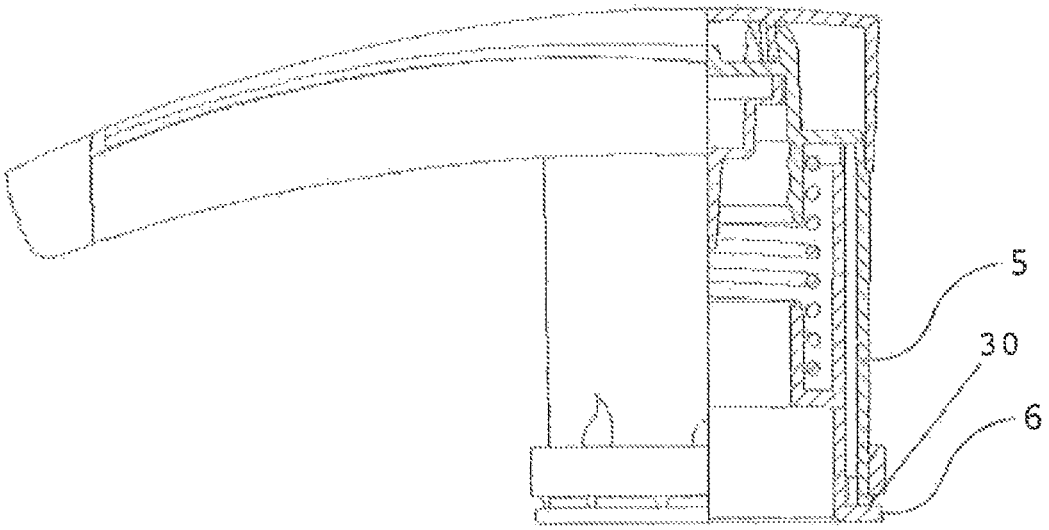
FIG. 14 shows a partially cross-sectioned view of another alternative example of a tamper-evident closure with a tamper-evident ring.

As shown in FIGS. 14, 14*a* and 14*b*, as an alternative the actuating element 5 can also be fixed in a position displaced downwards, such that the transport volume of the dispensing device 1 is advantageously reduced.

For fixing the actuating element 5 in a lower inoperative position, a preferably circumferential flange-like projection 30 is provided in s lower end section of the actuating element 5. Via this projection 30 the actuating element 6 can be held in the lower blocking position shown in FIG. 14 in conjunction with a tamper-evident ring 18'. If the pull-off flap 18" of the tamper-evident ring 18' is pulled off (in the direction of the arrow), the connection between the tamper-evident ring 18' and the bearing element 6, which in the example of embodiment shown is implemented via lands 31, is released, so that the actuating element 5 is released for the use of the dispensing device 1. Needless to say, all the designs described above can also be used for tamper-evident protection with a pull-off flap and/or a tamper-evident ring independently of the steps defining different displacement travels depending on the direction of rotation of the actuating element, i.e. they can be used with any dispensing device with a bearing element and an actuating element.

The invention claimed is:

1. A dispensing device comprising:

a pumping device, which has an actuating element with a discharge opening, the actuating element being displaceably arranged with respect to a bearing element, the bearing element being connected to a pump housing in a rotationally fixed manner in a usage position, and the actuating element being arranged such that it can rotate with respect to the bearing element, the bearing element has at least one projecting land with an upper stop edge, and an essentially tubular section of the actuating element has, extending inwardly from an inner surface, distributed over the circumference, at least two steps defining different displacement travels, of which, in each case, depending on the direction of rotation of the actuating element, one step in a lower displacement position strikes the upper stop edge.

2. The dispensing device in accordance with claim 1, wherein a lower edge of the tubular section of the actuating element in an upper inoperative position covers the upper stop edge of the bearing element.

3. The dispensing device in accordance with claim 1, wherein the steps are immediately adjacent to each other circumferentially and define a stepped profile.

4. The dispensing device in accordance with claim 1, wherein a width of the step corresponds in each case to a width of the land having the upper stop edge.

5. The dispensing device in accordance with claim 1, wherein guide lands extending in the displacement direction are provided in an extension of a jump in level between two adjacent steps.

6. The dispensing device in accordance with claim 1, wherein a blocking step is designed such that, when aligned with the upper stop edge, the actuating element is essentially blocked in its upper inoperative position.

7. The dispensing device in accordance with claim 1, wherein a flange-like projection is provided in a lower end section of the actuating element.

8. The dispensing device in accordance with claim 7, wherein the flange-like projection is a circumferential flange-like projection.

9. The dispensing device in accordance with claim 1, wherein a pull-off flap is provided, which is connected to the bearing element and blocks the displacement of the actuating element from an upper inoperative position.

10. The dispensing device in accordance with claim 1, wherein two diametrically arranged lands are provided, together with the upper stop edge and correspondingly diametrically configured steps.

11. The dispensing device in accordance with claim 1, wherein the bearing element is connected to the pump housing by a screw connection.

12. The dispensing device in accordance with claim 1, wherein the discharge opening of the actuating element is provided with a protective cap, which has a slot-shaped valve.

13. The dispensing device in accordance with claim 12, wherein the protective cap has a circumferential bead, which is accommodated in a detent groove of the actuating element arranged adjacent to the discharge opening.

14. The dispensing device in accordance with claim 12, wherein the protective cap consists of a thermoplastic elastomer (TPE) or silicone.

15. The dispensing device in accordance with claim 14, wherein the protective cap consists of a thermoplastic vulcanisate (TPV).

16. The dispensing device in accordance with claim 15, wherein the thermoplastic vulcanisate comprises ethylene-propylene-diene-monomer rubber particles (EPDM) in a matrix of polypropylene.

17. The dispensing device in accordance with claim 1, wherein the actuating element is connected to a piston rod, which is moved together with the actuating element, and wherein a valve element is accommodated in the actuating element, and the piston rod is displaceably accommodated in the pump housing, which is provided at one end with a one-way valve.

18. The dispensing device in accordance with claim 17, wherein the piston rod is moved together with the actuating element against the restoring force of an elastic spring element.

19. The dispensing device in accordance with claim 17, wherein the one-way valve comprises a ball valve.

20. The dispensing device in accordance with claim 1, wherein the pump housing is accommodated in a riser sleeve, in which a riser tube is accommodated, which is communicatively connected to the one-way valve.

21. The dispensing device in accordance with claim 20, wherein the pumping device is connected to the interior of a container and is connected to the container by a lid.

22. The dispensing device in accordance with claim 21, wherein the piston rod wherein the container accommodates a displaceably mounted overrun sleeve, which is connected in an essentially sealed manner to the riser sleeve and to the container.

23. The dispensing device in accordance with claim 22, wherein the overrun sleeve has a circumferential sealing lip, which widens conically upwards in a direction of the lid.

24. The dispensing device in accordance with claim 23, wherein the overrun sleeve has a circumferential a single sealing lip, which widens conically upwards in the direction of the lid.

* * * * *